US008042969B2

(12) United States Patent
Paik et al.

(10) Patent No.: US 8,042,969 B2
(45) Date of Patent: Oct. 25, 2011

(54) LIGHTING DEVICE AND METHOD OF ASSEMBLING THE SAME

(75) Inventors: Dongki Paik, Seoul (KR); Hyunha Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/088,920

(22) Filed: Apr. 18, 2011

(65) Prior Publication Data

US 2011/0194282 A1 Aug. 11, 2011

(30) Foreign Application Priority Data

Jun. 23, 2010 (KR) ..... 10-2010-0059558

(51) Int. Cl.
*F21V 1/00* (2006.01)

(52) U.S. Cl. ..... 362/241; 362/249.02; 362/243; 362/247; 362/294

(58) Field of Classification Search ..... 362/249.02, 362/235, 237, 239, 240, 241, 243, 247, 373, 362/294, 547
See application file for complete search history.

(56) References Cited

U.S. PATENT DOCUMENTS

| | | | | |
|---|---|---|---|---|
| 6,814,470 | B2 * | 11/2004 | Rizkin et al. | 362/327 |
| 7,281,818 | B2 * | 10/2007 | You et al. | 362/241 |
| 2009/0303715 | A1 * | 12/2009 | Takasago et al. | 362/235 |
| 2010/0067224 | A1 * | 3/2010 | Wu | 362/235 |
| 2010/0128485 | A1 * | 5/2010 | Teng et al. | 362/294 |

FOREIGN PATENT DOCUMENTS

| | | | |
|---|---|---|---|
| JP | 2010049830 | A | 3/2010 |
| KR | 100931600 | B1 | 3/2006 |
| KR | 100565771 | B1 | 12/2009 |
| KR | 2020100005008 | U | 5/2010 |
| KR | 1020100058807 | A | 6/2010 |
| KR | 1020100064800 | A | 6/2010 |
| KR | 1020100075582 | A | 7/2010 |

OTHER PUBLICATIONS

Korean Prior Art Search Report dated Mar. 31, 2011.

* cited by examiner

*Primary Examiner* — Ali Alavi
(74) *Attorney, Agent, or Firm* — KED & Associates, LLP

(57) ABSTRACT

A lighting device and a method of assembling the same are disclosed herein. The lighting device may include a lens assembly having a plurality of condensing lenses, a reflector having a plurality of openings, and a light emitting module having a plurality of LEDs. The condensing lenses, the plurality of openings, and the LEDs may be positioned to correspond to each other. The reflector may reflect light emitted from the light emitting elements to maximize light distribution efficiency of the lighting device.

22 Claims, 8 Drawing Sheets

LIGHTING DEVICE AND METHOD OF ASSEMBLING THE SAME

CROSS-REFERENCE TO RELATED APPLICATION(S)

This application claims priority under 35 U.S.C. §119 to Korean Patent Application No. 10-2010-0059558, filed in Korea on Jun. 23, 2010, which is hereby incorporated by reference in its entirety.

BACKGROUND

1. Field

A lighting device is disclosed herein having improved light distribution efficiency and improved assembly efficiency.

2. Background

Lighting devices are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Light emitting diodes (LEDs) or LED devices may be semiconductor devices that produce light of various colors or intensities. LEDs may emit light through carrier injection and recombination in a p-n junction of a semiconductor. Wavelengths of luminescent light may vary based on the types of impurities which are added. For example, the luminescent light corresponding to elements zinc and oxygen is red (wavelength of 700 nm) and light corresponding to nitrogen is green (wavelength of 550 nm). An LED may have a compact size, longer life span, higher efficiency, and higher response speeds when compared to conventional light sources. Lighting devices as disclosed herein allows a more efficient utilization and conservation of energy resources.

An LED based light source may use a plurality of LED elements to supply the required amount of light. If the LED lighting device is used for simple lighting, an opaque diffusing cap may be used to diffuse or remove the directionality of the emitted light. If the LED lighting device is used to provide a directionally projected light, a lens structure may be provided in the lighting device that may be configured to collect and distribute the light with a specific directionality.

For LED lighting devices that produce directionally projected light, it may be difficult to position the lens structure onto the plurality of LED elements. Hence, a method of assembling the lighting device is required to easily locate and maintain the relative position of the lens structure on the plurality of LED elements during assembly.

Figure 1:
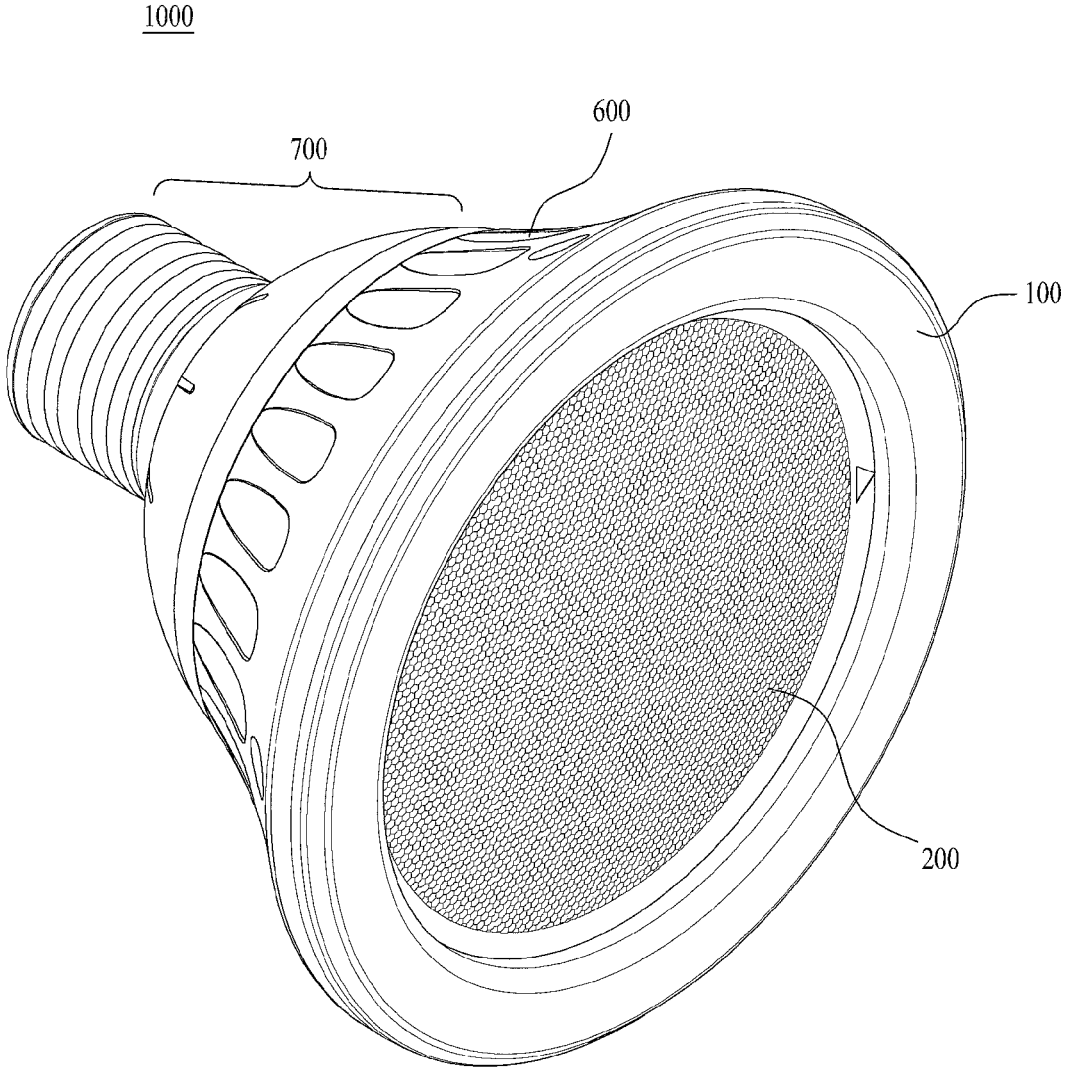
FIG. 1 is a perspective view of a lighting device according to an embodiment of the present disclosure.

FIG. 1 is a perspective view of a lighting device according to an embodiment of the present disclosure. The lighting device 1000 according to this embodiment may include a light emitting module having a light emitting element mounted therein, a lens assembly 200 (or lens member) having a plurality of condensing lenses projected toward the light emitting element, a heat sink 600 configured to radiate heat generated from the lighting emitting module, and a reflector (reflecting member) provided between the light emitting module and the lens assembly 200. The reflector may include a plurality of light emitting element holes (or openings) and one or more partitions. Each of the plurality of the holes may be configured to allow a corresponding light emitting element to be exposed towards the lens assembly 200. Each of the plurality of holes may be separated or distinguished from each other by the partitions. The partition may be a projected partition (or protruding partition) that is formed to project towards the lens assembly 200. The projected partition may be formed as a wall or divider to separate each of the holes.

Simply for ease of discussion, the light emitting element is described herein as being an LED or LED element. However, the embodiments are not limited thereto, and various types of light emitting elements may be applicable to the present disclosure. For example, the light emitting module may include a variety of tunes of light emitting elements mounted on a substrate provided therein, and may include any type of light source capable of generating a light when a voltage is applied thereto.

The lighting device 1000 may include the LED module provided in an upper portion of the heat sink 600, and the lens assembly 200 may be configured to collect and distribute the light generated from the LED module. The lens assembly 200 may be made of a photo-permeable material and a cover-ring 100 may be fixed to the heat sink 600 to secure the LED module therein. The method of attaching the cover-ring 100 to the heat sink 600 will be described in further detail with reference to FIG. 8 hereinbelow.

A base 700 may be provided in a lower portion of the heat sink 600. The base 700 may include an electrical control unit. The base 700 may include a power socket configured to supply the commercial voltage to the electrical control unit. The electrical control unit may be provided inside the base 700. The electrical control unit may convert the commercial voltage into an input voltage appropriate for the light emitting module. For example, the LED may require a DC current. Hence, the electrical control part may include various electrical components such as an AC-DC converter, a transformer configured to control the voltage level, and the like. Moreover, the cover-ring 100 may be secured to the heat sink 600 to support a circumference of the lens assembly 200.

Figure 2:
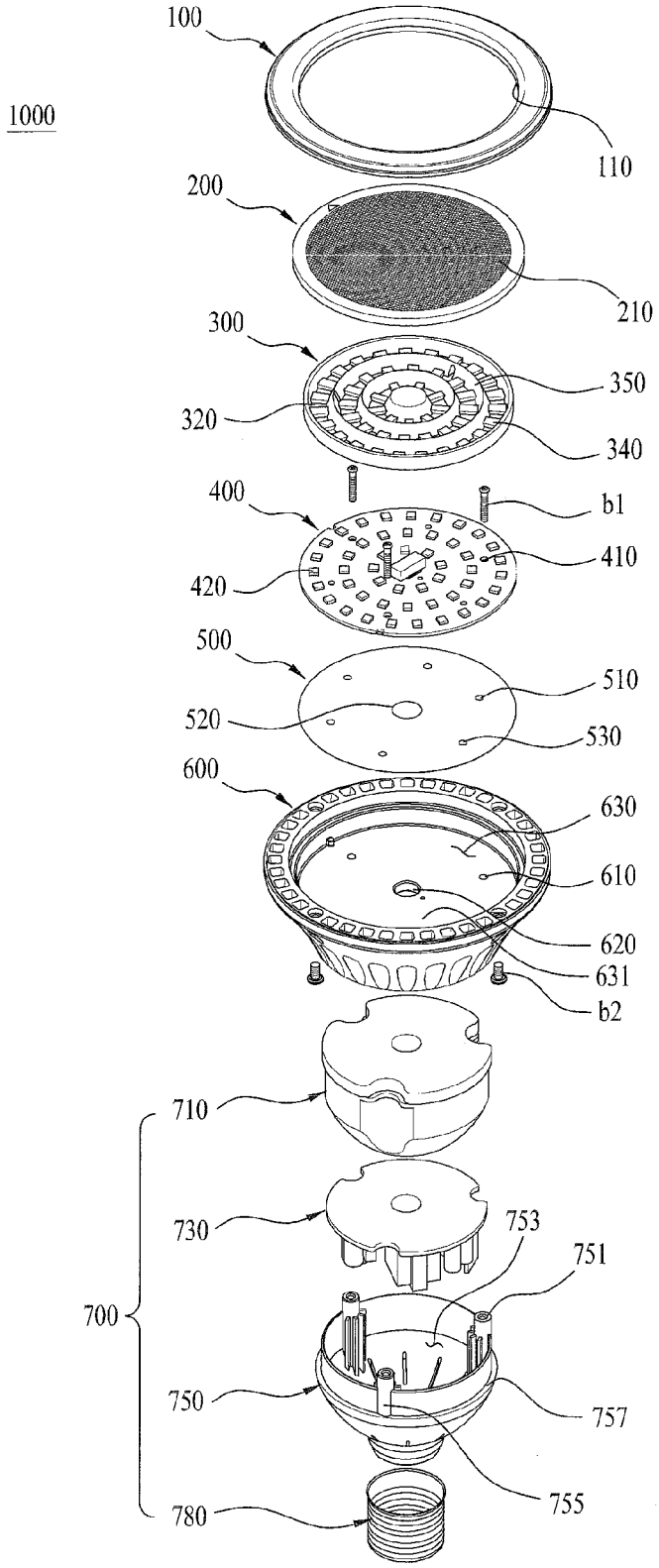
FIGS. 2 and 3 are exploded perspective views of the lighting device of FIG. 1.
Figure 3:
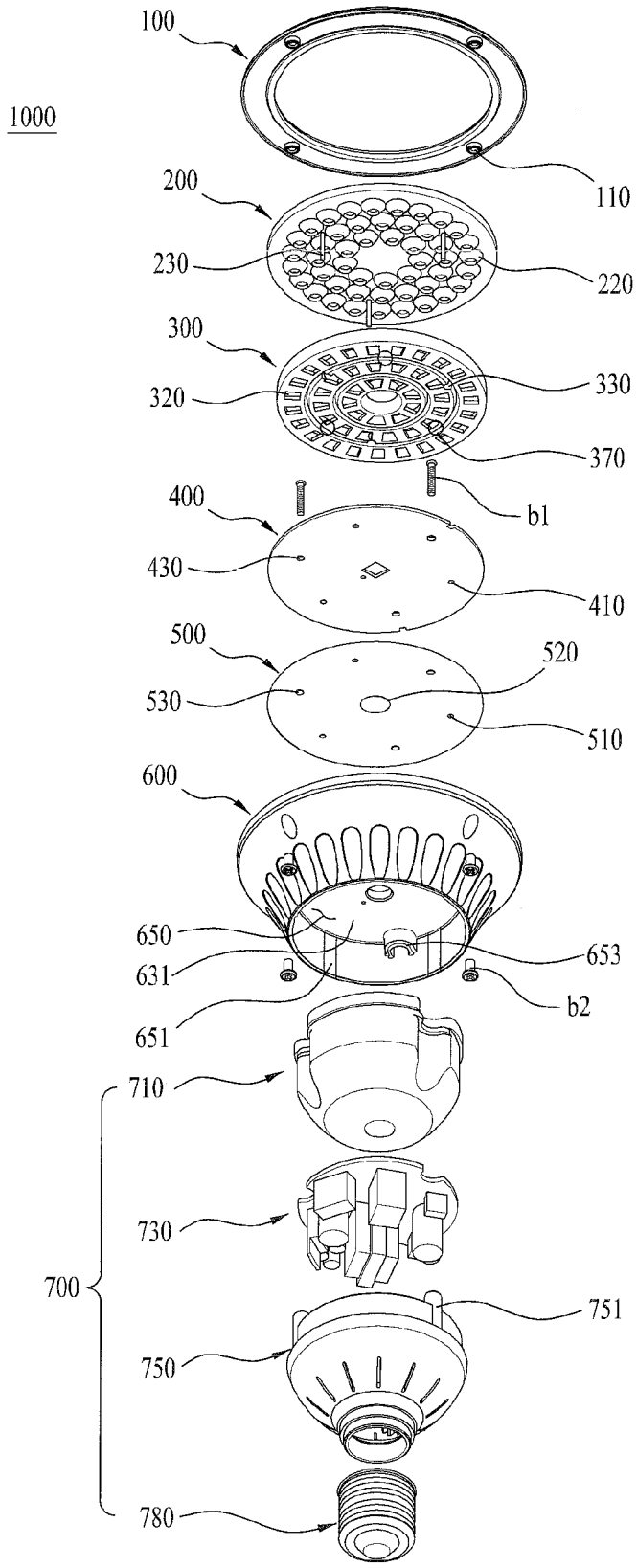

FIGS. 2 and 3 are exploded perspective views of the lighting device 1000 viewed from different angles. Referring to FIG. 2, the LED module 400 may include a plurality of LEDs 420. The LED module 400 may include a substrate on which the plurality of the LEDs 420 may be mounted. The substrate having the LEDs 420 mounted thereon may be formed of a heat conducting material such as a metal or another appropriate type of thermally conductive material. Accordingly, heat generated from the LEDs 420 may be radiated toward the heat sink 600 quickly. As shown in FIG. 2, the LED 420 may be arranged on the substrate in a radial direction, for example, to form concentric rings or rows.

While the LEDs 420 are disclosed herein as being arranged in concentric rings or rows, the embodiment is not limited thereto. The LEDs 420 may be arranged in any pattern to optimize the optical efficiency and desired light output characteristics. For example, the light emitting elements 420 may be arranged in a pattern that allow a maximum number of light emitting elements 420 to be positioned on light emitting module 400 to increase the light output of the lighting device 1000.

The lighting emitting module 400 may be secured in an upper portion of the heat sink 600. The light emitting module 400 may be secured in an upper recess 630 such that heat generated from the light emitting module 400 may be dissipated towards the heat sink 600. A heat conduction pad 500 may also be provided between the LED module 400 and the heat sink 600 to improve heat transfer between the LED module 400 and the heat sink 600. The heat conduction pad 500 may maximize the heat transmission function between the LED module 400 and the heat sink 600. Moreover, a contact area between the light emitting module 400 and the heat sink 600 may be increased to improve the heat dissipation efficiency. For example, the contact area may be increased by using a flexible material for the heat conduction pad 500.

In certain embodiments, a heat sink compound may be applied between the heat sink 600 and the LED module 400 to improve thermal conductivity. Moreover the heat sink compound may also be an adhesive material to affix the LED module 400 to the heat sink 600.

In addition, a reflector 300 (reflecting member) may be provided on the LED module 400. The reflector 300 may be provided between the LED module 400 and the lens assembly 200, and may include a plurality of LED holes 320 and a plurality of partitions 340, 350. LEDs 420 may be exposed through the LED holes 320 of the reflector 300 to face the lens assembly 200. Each of the LED holes 320 may be formed at side edges of the partitions such that the LED holes 320 are separated from each other.

For example, the partitions may include one or more projected partitions 350 that may be projected toward the lens assembly 200 and formed in concentric rings as shown in FIG. 2. The partitions may also include one or more level partitions 340 (or spokes) positioned to extend radially and connected to the projected partitions 350. The resulting openings between the projected partitions 350 and level partitions 340 may then form the LED holes 320. The projected partition 350 provided on the reflector 300 may have a shape that corresponds to a shape of a rear surface of the lens assembly 200 and attached to the reflector 300 by the level partitions 340.

The plurality of the LED holes 320 provided in the reflector 300 may be mounted on an upper portion of the LED module 400, and the LEDs 420 may be exposed through the LED holes 320. When the LEDs 420 provided on the LED module 400 are mounted in a particular arrangement, the LED holes 320 provided in the reflector 300 may also be arranged in the same fashion such that they correspond to the LEDs 420.

For example, according to an embodiment as shown in FIG. 2, a plurality of LEDs 420 may be mounted in a radial arrangement (e.g., concentric rows) on the LED module 400. A plurality of LED holes 320 may also be formed in the reflector 300 in a corresponding radial arrangement such that the LEDs 420 may protrude through the LED holes 420. Light emitted from the LEDs 420 may then be reflected toward the lens assembly 200 by the reflector 300. That is, when the LEDs 420 mounted in the LED module 400 are arranged in concentric rows, the LED holes 320 provided in the reflector 300 may also be arranged in concentric rows such that each LED 420 may be positioned to correspond to each LED hole 320.

The reflector 300 may include a coupling hole 310 to accommodate a coupling member b1 (connector) therein. The coupling member b1 may be inserted through coupling hole 310 of the reflector 300 and coupling hole 410 of the LED module 400 to couple both components to the heat sink 600. Alternatively, the reflector 300 may be mounted on the LED module 400 without the use of coupling hole 310 or connector b1. For example, the reflector 300 may be secured by the cover-ring 100. That is the reflector 300 may be positioned on the LED module 400. The lens assembly 200 may then be positioned over the reflector 300 such that the condensing lenses 220 mate with corresponding protruding partitions 350 of the reflector 300. The lens assembly 200 may then be supported on its outer circumferential edge by the heat sink 600 and coupled thereon by coupling-ring 100. Accordingly, in this embodiment, the reflector 300 and the lens assembly 200 may be mounted in the lighting device 1000 without being coupled by connector b1. The positioning of the lens assembly 200 on the reflector 300 and LED module 400 is described in further detail with respect to FIGS. 7 and 8 hereinbelow.

The LED module 400 may be seated in a securing space 630 (upper recess) formed in the upper portion of the heat sink 600. The reflector 300 may be made of a predetermined material having a desired reflectivity such that it reflects the emitted light towards the lens assembly 200. The reflector 300 may reflect and redirect light which is emitted laterally along a surface of the metal substrate or the side surface of the upper recess 630 towards the lens assembly 200. That is, the reflector 300 may increase the optical efficiency of the LED module 400 by redirecting scattered or diffused light towards the lens assembly 200 for output in a predetermined direction.

The heat sink 600 may be made of a metal material to quickly dissipate heat generated from the LED module 400. While the upper recess 630 may be provided in the upper portion of the heat sink 600, an inserting space 650 (lower recess) may be provided in a lower portion of the heat sink 600 to receive the base 700. In other words, a bottom surface of the upper recess 630 may separate the upper recess 630 and the lower recess 650 from each other in the heat sink 600.

The base 700 may include the electrical control part 710 and/or 730 which is configured to convert a commercial voltage into a voltage required for the LED module 400. A housing 750 may be provided to accommodate the electrical control part 710 and/or 730. The housing 750 may include a recess 753 (accommodating space) inside which the electrical control part 710 and/or 730 may be positioned.

The housing 750 may include at least one coupling boss 751 formed in an upper end of the housing 750 to be coupled to the LED module 400. The coupling boss 751 may be directly coupled with the LED module 400 by the coupling member b1, which may be a bolt, screw, or another appropriate type of coupling device. A coupling hole 610 may be provided on a bottom surface of the upper recess 630 formed in the heat sink 600, and the coupling member b1 may be connected to the coupling boss 751 of the housing 750 via the coupling hole 610.

Moreover, the height of the coupling boss 751 may be formed to be a height such that the coupling boss 751 protrudes through the coupling hole 610 into the upper recess 630 or is coplanar with a bottom surface of the upper recess 630. For example, the coupling boss 751 may be formed at a top end of the guide rib 755, to extend vertically from the top edge of the housing 750. When the housing 750 is assembled with the lower cavity 650, the top edge of the housing 750 may be positioned adjacent to the top surface of the lower cavity 650. Each coupling boss 751 may then be inserted into a corresponding coupling hole 610 such that the top end of the coupling boss 751 is coplanar with the mounting surface in the upper recess 630. For example, a height of the coupling boss 751 may be formed to be the same as the thickness of the mounting plate 631.

The electrical control part 710 and/or 730 may include an AC-DC converter configured to convert an alternative current (AC) into a direct current (DC). Electrical control parts 710 and 730 may be connected to the LED module 400 via a connecting hole 620 that may be formed in the heat sink 600. An electrode 780 may be provided in a lower portion of the base 700 to supply the commercial voltage to the electrical control part 730. The electrode 700 may be an electrical plug, screw type base, or another appropriate type of electrical connector. The electrode 780 may be connected to a commercial voltage supply socket to receive power.

The electrode 780 may be mounted in a lower end of the housing 750 and configured to supply power to the electrical control part 710 and/or 730 which is electrically connected with the LED module 400. According to the lighting device 1000 of the present disclosure, the housing 750 including the electrical control part 710 and/or 730 and the electrode 780 may be inserted into the lower recess 650 of the heat sink 600. Hence, the heat sink 600 may be coupled by the coupling member b1 to both the LED module 400, secured in the upper recess 630 formed in the upper portion of the heat sink 600, and the base 700, secured in the lower recess 650 formed in the lower portion of the heat sink 600.

In other words, the coupling member b1 may couple the LED module 400 to the housing 750 with the heat sink 600 located therebetween. Because the heat sink 600 may be fixed between the LED module 400 and the housing 750, the number of coupling members b1 which may be necessary can be minimized and the assembling process may be simplified.

As shown in FIG. 2, a guide rib 755 may be provided on an outer surface of the housing 750 to guide the insertion of the base 700 into the lower recess 650. That is, the guide rib 755 may guide the housing 750 into the lower recess 650 of the heat sink 600. In addition, a guide groove 651 may be provided on an inner side surface of the lower recess 650 formed in the heat sink 600 to correspond to the guide rib 755 such that it may be seated therein. The locations of the guide rib 755 and the guide groove 651 may be reversed. For example, the guide rib 755 may be positioned in the lower recess 650 and the guide groove 651 may be positioned on the housing 750. Moreover, the number of guide ribs 755 and guide groove 651 provided may be variable. If more than one pair of guide rib 755 and guide groove 651 are provided, they may be spaced at different intervals such that they may guide an orientation of the base 700 inside the lower recess 650. That is, the base 700 may be keyed to the lower recess 650 by the guide rib 755 and guide groove 651.

A hooking protrusion 757 configured to limit the insertion depth of the housing 750 may be provided on a lower end of the outer surface of the housing 750. The insertion depth of the housing 750 into the lower recess 650 may be limited by hooking the hooking protrusion 757 to the lower end or lower circumferential edge of the heat sink 600.

As mentioned above, the reflector 300 may be positioned on the LED module 400. The reflector 300 may include the plurality of the LED holes 320 to expose the LEDs 420 therethrough. The lens assembly 200 may be positioned on the reflector 300. As shown in FIG. 3, the lens assembly 200 may include a plurality of condensing lenses 220. The condensing lenses 220 may be employed to collect light emitted from the LEDs 420 and to project them with a specific directionality. Each of the condensing lenses 220 may include a recessed portion 220*g* formed in a center portion and a sloped side surface 220*s* formed around the recessed portion 220*g* (see FIG. 6C). For example, the recessed portion 220*g* may be positioned at a distal end of each condensing lens 220. Each recessed portion 220*g* may be configured to face each corresponding LED 420. The condensing lenses 220 will be described in further detail with reference to FIG. 6 hereinbelow.

The lighting device 1000 according to the present disclosure may include a location determining bar (alignment pin/bar) and a location determining hole (alignment hole) to improve efficiency during assembly of the lighting device 1000. Since the lens assembly 200, the reflector 300, and the LED module 400 may be disc-shaped, an orientation or position of each part must be precise to enable precise mating and to prevent gaps therebetween.

Referring to FIG. 3, a location determining bar 230 may be provided on the lens assembly 200 and location determining holes 330 and 430 may be provided on the reflector 300 and the LED module 400, respectively. The location determining bar 230 may be inserted through the location determining holes 330 and 430 to correctly align the lens assembly 200, reflector 300, and the LED module 400 during assembly. Alternatively, the location determining bar 230 may be positioned on the LED module 400 and the location determining holes 330, 430 may be positioned on the reflector 300 and the lens 200, respectively, to correspond to the position of the location determining bar 230.

In another embodiment, a location determining bar may be provided on the reflector 300. In this case, since reflector 300 is positioned between the lens 200 and LED module 400, the location determining bar 230 may be positioned on both surfaces of the reflector 300. That is, a location determining bar may be provided on a surface of the reflector 300 that faces the lens 200 to mate with a corresponding location determining hole provided thereon, and an additional location determining bar may be provided on an opposite surface of the reflector 300 that faces the LED module 400 to mate with a corresponding location determining hole provided on the LED module 400.

Figure 4:
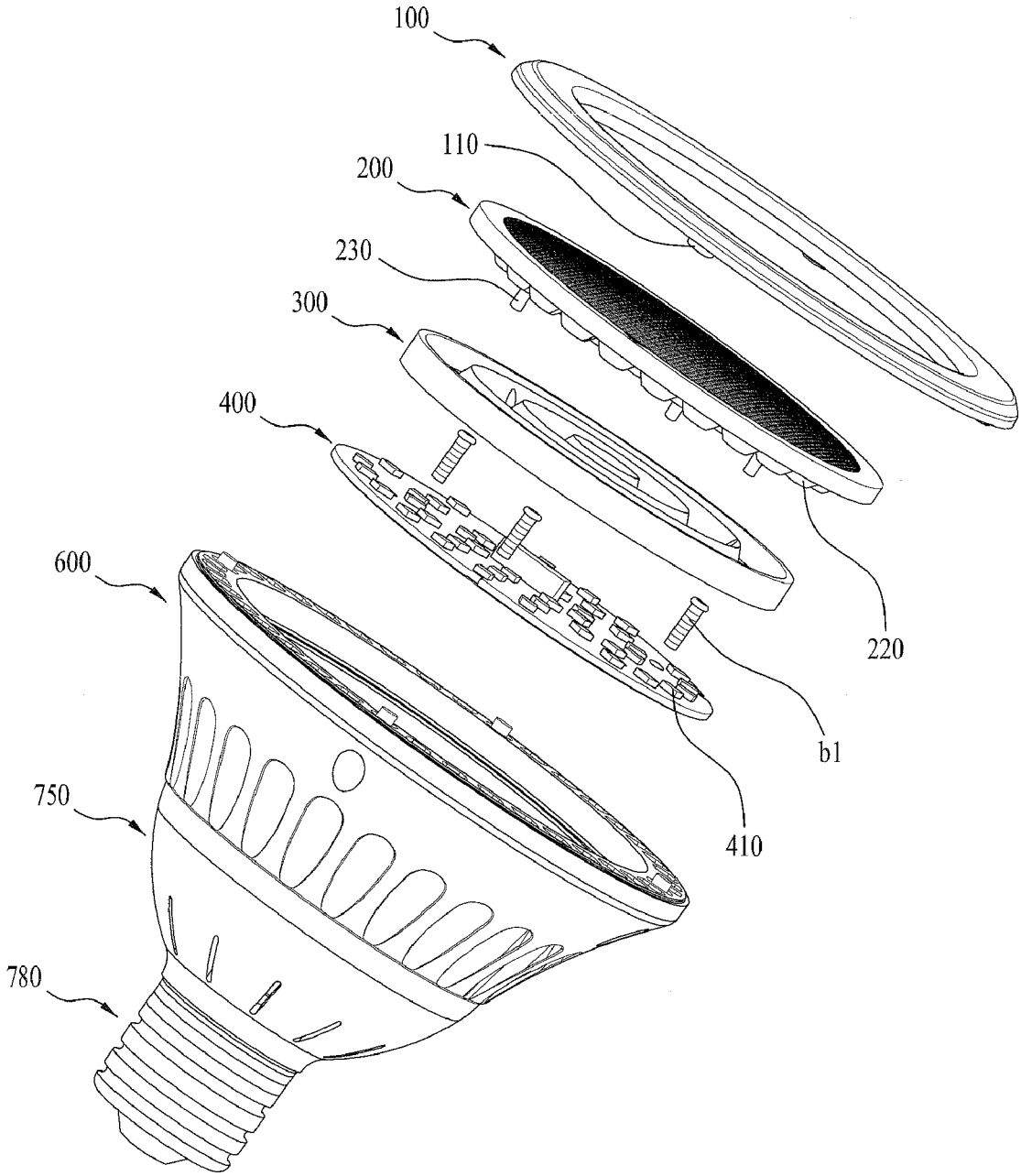
FIG. 4 is another exploded perspective view of the lighting device according to the present disclosure.
Figure 5:
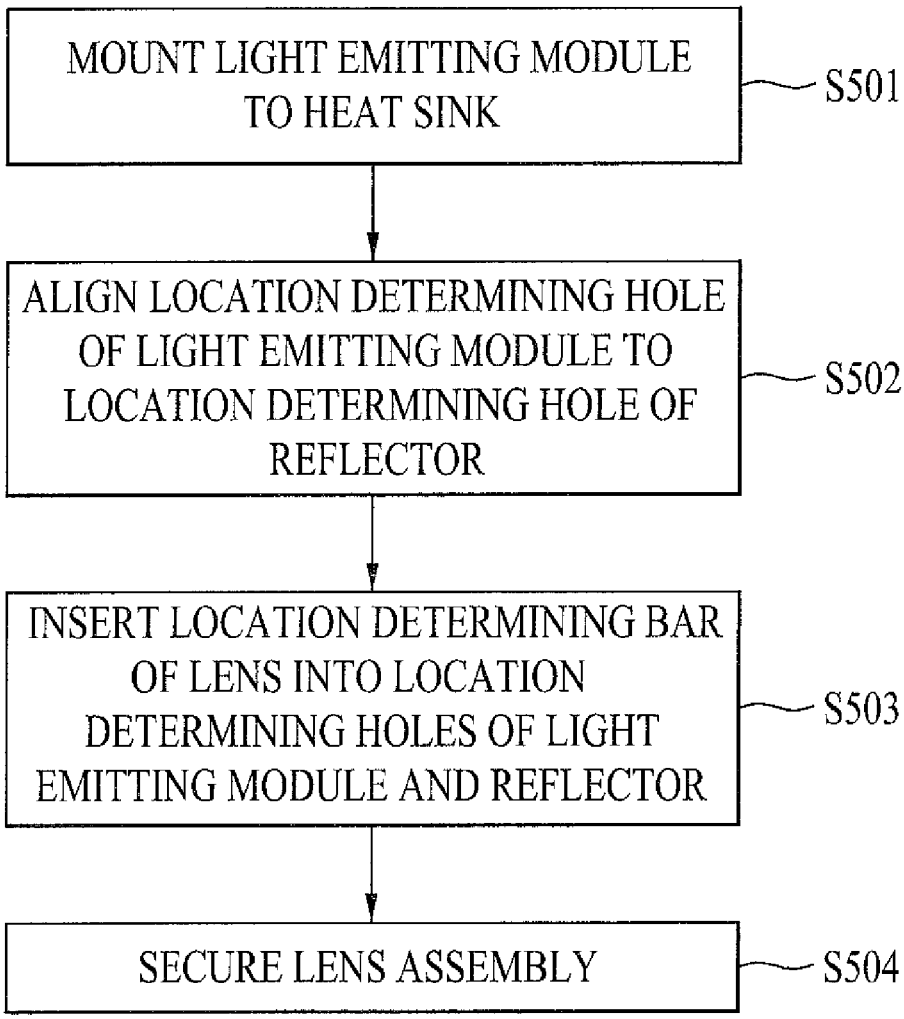
FIG. 5 is a flowchart showing a method of assembling the lighting device according to an embodiment of the present disclosure.

FIG. 4 is an exploded perspective view of the lighting device 100 according to the present disclosure. FIG. 5 is a flowchart showing a method of assembling the lighting device 1000 according an embodiment of the present disclosure. The method of assembling the lighting device of FIG. 5 will be described in reference to the description the lighting device 1000 of FIGS. 2, 3, and 4.

Referring to FIG. 4, the location determining bar 230 may be integrally formed on a rear surface of the lens assembly 200 (the surface having the condensing lenses). At least one location determining bar 230 may be provided on the rear surface of the lens assembly 200 and may be inserted into location determining holes 330 and 430 formed on the reflector 300 and the LED module 400, respectively, to align the lens assembly 200 thereto.

The LED module 400 which may be positioned in the upper recess 630 of the heat sink 600 may be coupled to either the heat sink 600 or the housing 750 by the connector b1. The reflector 300 and the lens assembly 200 may be mounted above the LED module 400 and secured in place without any additional connectors through use of the cover-ring 100. Hence, when a location determining bar 230 and cover-ring 100 are provided, the components of the lighting device 1000 may be assembled quickly and efficiently while eliminating the need for additional connectors.

However, if the location determining bar 230 is not provided, it may be difficult to properly align the various components of the lighting device 1000. For example, if the lens assembly 200 is configured to have a circular shape and the LEDs 420 are mounted on the LED module 400 in a radial arrangement, e.g., in concentric rings or rows, any differences in the widths and lengths of the LEDs 420 may cause the spacing between the LEDs 420 to vary. Thus the spacing between two of the LEDs 420 having a predetermined area or footprint may not be the same.

Moreover, an inner row or ring of LEDs near the center of the LED module 400 may have a smaller number of LEDs 420 than an outer row or ring of LEDs near the outer edge of the LED module 400. That is, an LED 420 on a first row or ring may not align with an LED 420 on another row or ring in a radial direction. Accordingly, the locations of the LED holes 310 of the reflector 300 provided above the upper portion of the LED module 400 may not align properly to the LEDs 420 if the reflector 300 is not positioned correctly. As a result, it may be difficult to determine the accurate mounting locations and directions of the reflector 300 and the lens assembly 200 provided on the LED module 400 during an assembly process.

Accordingly, difficulty in assembling the reflector 300 and lens 200 to the LED module 400 may delay the overall efficiency during assembly of the lighting device 1000. That is, after the locations of the reflector 300 and the lens assembly 200 are determined, the cover-ring 100 may be coupled to the outer circumference of the lens assembly 200 to complete the assembly of the lighting device. However, difficulty in correctly aligning each of the plurality of LED holes 320 and condensing lenses 220 to each corresponding LEDs 420 may delay the overall assembly process. Hence, the lighting device 1000 of this embodiment may be provided with the location determining bar 330 provided on the back surface of the lens assembly 200 and the location determining holes 330 and 430 provided on the reflector 300 and the LED module 400, respectively, to improve the efficiency of the assembling process.

Referring to FIG. 5, once the LED module 400 is mounted to the heat sink 600, in step S501, the location determining hole 430 formed in the LED module 400 may be aligned with the location determining hole 330 formed in the reflector 300, in step S502. The location determining bar 230 formed on the rear surface of the lens assembly 200 may be inserted through the location determining holes 330 and 430 formed in the reflector 300 and the LED module 400, respectively, in step S503. Accordingly, the mounting direction of the lens assembly 200 may be precisely aligned. The lens assembly 200 may then be secured in place, for example, by a cover-ring 100 or another appropriate connector, in step S504.

Figure 6A:
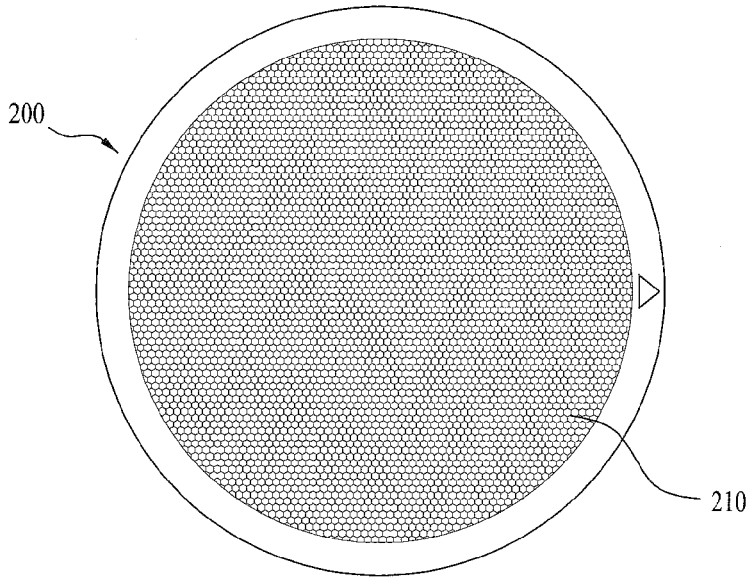
FIGS. 6A-6C are diagrams of a lens assembly of the lighting device according to the present disclosure.
Figure 6B:
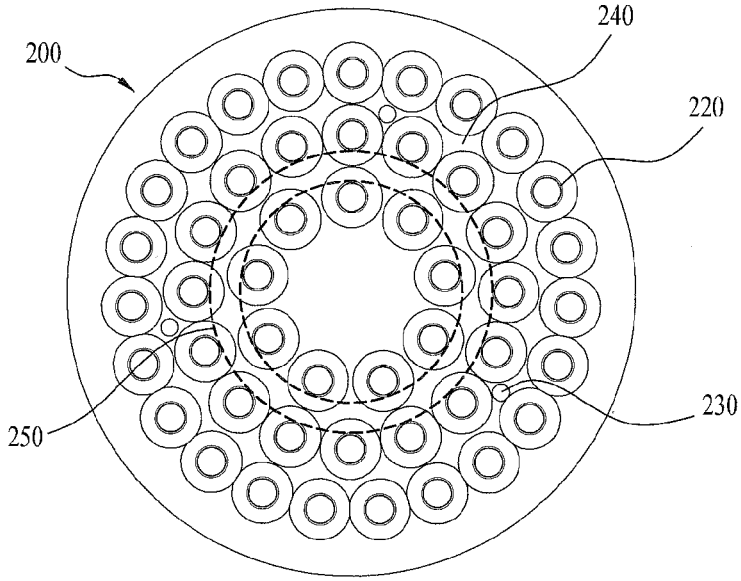
Figure 6C:
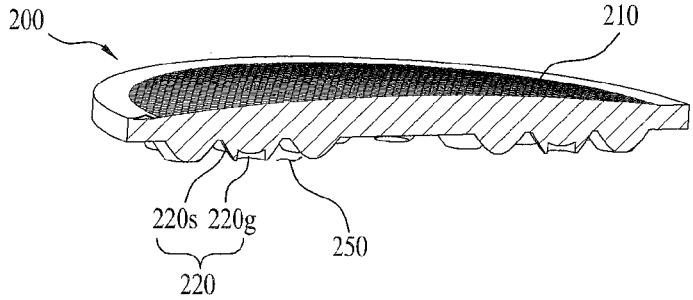

FIGS. 6A-6C are diagrams of the lens assembly 200 of the lighting device 1000 according to the present disclosure. Specifically, FIG. 6A is a diagram of a top (or front) surface of the lens assembly 200 and FIG. 6B is a diagram of a bottom (or rear) surface of the lens assembly 200. FIG. 6C is a sectional view of the lens assembly 200.

As shown in FIG. 6A, a front surface of the lens assembly 200 may be a light projection surface 210 that may include a micro lens array. The micro lens array may be a predetermined arrangement of micro lenses provided on the light projection surface 210. The micro lens array provided on the light projection surface 210 may improve light distribution efficiency and projected light quality.

As shown in FIG. 6B, a plurality of condensing lenses 220 may be provided on a rear surface of the lens assembly 200. The plurality of condensing lenses 220 may be positioned in concentric rows or rings relative to a center of the lens assembly 200. Each of the condensing lenses 220 may be formed to have a semispherical (curved side surfaces), cone (linear side surfaces), or another appropriate shape that focuses and redirects the emitted light. Moreover, a shape of the condensing lenses 220 on one concentric row may be different than a shape of the condensing lenses 220 on another concentric row.

The side surface 220*s* of the condensing lens 220 may be projected to incline from the surface of the lens assembly 200 at a predescribed angle. As described above, the side surface 220*s* may be formed to incline in a straight line when the condensing lens 220 is shaped in a cone shape. Alternatively, the side surface 200*s* may be formed to be curved when the condensing lens 220 is shaped in a semispherical or dome shape. The curvature or shape of the side surface 220*s* may be formed to achieve a desired optical effect and directionality of projected light from the lens assembly 200. Moreover, the curvature or shape of the projected partitions 350 of the reflector 300 may be formed to correspond to the curvature or shape of the condensing lenses 220, as described in further detail hereinbelow with reference to FIGS. 7B-7C.

One or more location determining bars 230 may be provided in a gap or window 240 on the rear surface of the lens assembly 200. The gap 240 may be an area on the lens assembly 200 in between the plurality of condensing lenses 220. However, this embodiment is not limited thereto, and the location determining bar 230 may also be formed on a sloped side surface of the condensing lens 220. The location determining bar 230 may be configured to allow positioning and aligning of the lens assembly 200 as previously described, and may be integrally formed on the lens assembly 200.

A recessed portion 220*g* may be provided on an end of the condensing lens 220, as shown in FIG. 6C. The recessed portion 220*g* may be positioned to correspond to a position of an LED 420 provided on the LED module 400 such that the light emitted from the LED 420 may be received in the recessed portion 220*g*. The sloped side surface 220*s* may be formed around the recessed portion 220*g* to further direct or reflect emitted or scattered light into the recessed portion 220*g* such that light distribution efficiency may be improved. In other words, the plurality of the recessed portions 220*g* may be formed on the rear surface of the lens assembly 200 to receive light emitted from the LED elements 420. The recessed portions 220*g* may be provided at the ends of the condensing lenses 220 which may be formed to protrude towards and positioned to correspond to the LEDs 420.

Moreover, the recessed portions 220*g* may be formed in various shapes to vary the characteristics of the light projected from the lens assembly 200. For example, the recessed portions 220*g* may have a vertical or an inclined side surface. The side surfaces of the recess 220*g* may be formed to be linear (cone shaped recess) or curved (spherically shaped recess). The top surface of the recess may be formed to be convex, concave, flat, or another appropriate shape according to a desired optical effect of the projected light.

As shown in FIGS. 6B and 6C, the condensing lenses 220 may be arranged in concentric rows or rings. The condensing lenses 220 may be positioned a predetermined distance from, adjacent to, or to overlap each other. For example, two condensing lenses 220 may be positioned such that an outer edge of a lens overlaps a neighboring lens. Alternatively, a condensing lens 220 may be positioned to be spaced apart from a neighboring condensing lens 220. As the lenses 220 may be positioned in concentric rows, seating recesses 250 may be formed between the condensing lenses 220 along a circumferential direction around the row of lenses 220. When the lens assembly 200 is positioned on the reflector 300, the projected partitions 350 of the reflector 300 may be seated in the seating recesses 250 of the lens assembly 200.

The seating recess 250 may be a recess formed by the sloped side surfaces 220*s* of each condensing lens 220. A plurality of seating recesses 250 may be formed in concentric rows or rings between the rows of condensing lenses 220. A plurality of projected partitions 350 may be projected toward the seating recess 250 and formed to correspond to the seating recesses 250.

Figure 7A:
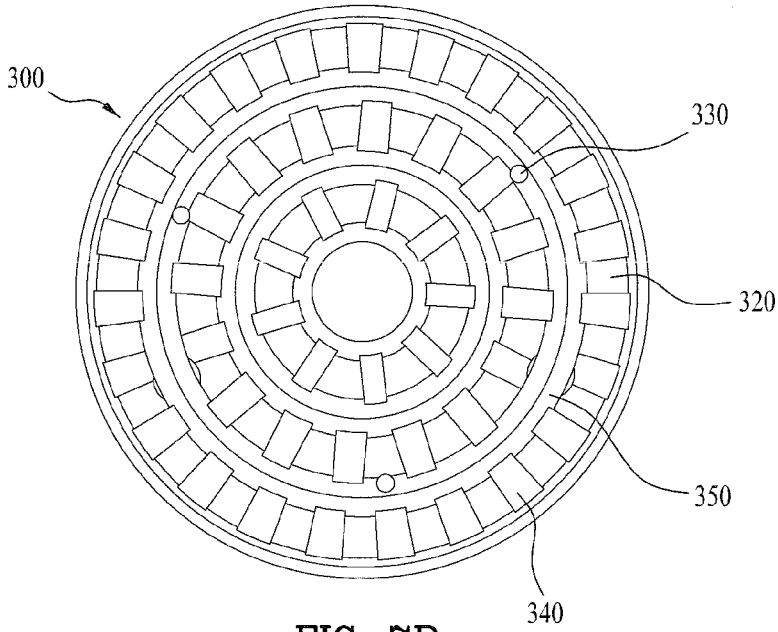
FIGS. 7A-7C are diagrams of a reflector of the lighting device according to the present disclosure.
Figure 7B:
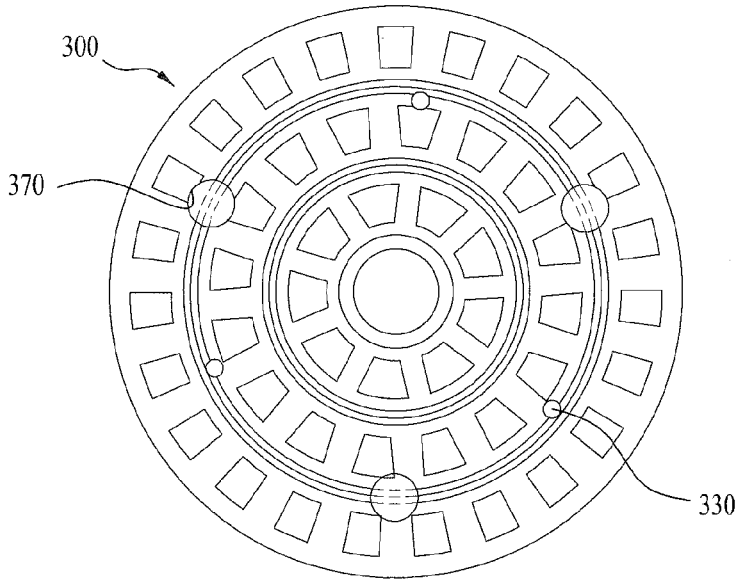
Figure 7C:
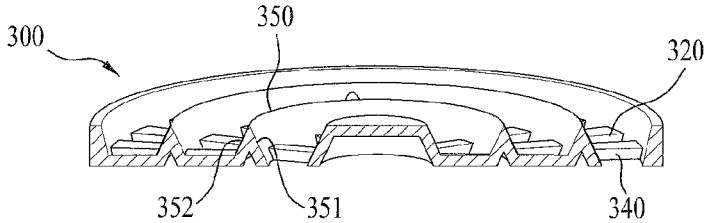

FIGS. 7A-7C are diagrams of a reflector of the lighting device 1000 according to the present disclosure. FIG. 7A is a diagram of a top (or front) surface of the reflector 300 and FIG. 7B is a diagram of a bottom (or rear) surface of the reflector 300. FIG. 7C is a sectional view of the reflector 300.

The reflector 300 may be provided to reflect diffused light towards the lens assembly 200. For example, light emitted or diffused from an LED 420 away from the condensing lens 220 (e.g., in a lateral direction along the surface of the LED module 400) may be reflected by the projected partition 350 towards the condensing lens 220. Thus, the reflector 300 may improve light emission efficiency by redirecting diffused or laterally emitted light.

The reflector 300 may include a plurality of LED holes or openings 320 through which the plurality of LEDs 420 may be positioned. For example, the plurality of LEDs 420 may be positioned to protrude through a corresponding opening 320 towards the lens assembly 200. Accordingly, light emitted from the LEDs 420 may be directed towards the lens assembly 200 without obstruction. The outer edges of the LED holes 320 may be formed by the plurality of partitions 340, 350 provided on the reflector 300. For example, the LED holes 320 may be formed between the level partitions or spokes 340 which separates the LED holes 320 in a circumferential direction and the projected partition or wall 350 which separates the LED holes 320 in a radial direction. Moreover, one or more projected partitions 350 may be formed on the reflector 300. The projected partitions 350 may be formed to be concentric circles or rings to correspond to the seating recess 250 formed by a row of condensing lenses 220, as previously described.

In this embodiment, only the projected partition 350 is described as having a projected shape. However, the reflector 300 as disclosed herein is not limited thereto. The level partition 340, configured to distinguish or separate the LED holes 320 in the circumferential direction, may be formed to project towards the lens assembly 200 and projected partition 350 may be formed to be flat. Moreover, both the projected partition 350 and the level partition 340 may have the projected shapes, and thus, configured to reflect diffused light in both the radial and circumferential directions.

The location determining hole 330 may be provided at a predetermined location on the partition that corresponds to the location determining bar 230 provided on the lens assembly 200. The location determining hole 330 may be formed through the top and bottom surfaces of the reflector 300 and positioned to allow the location determining bar 230 to pass through the location determining hole 330. Accordingly, the positioning and orientation of the lens assembly 200 may be precisely determined to align the lens assembly 200 to the reflector 300. Moreover, if the lens assembly 200 and reflector 300 are mounted on the LED module 440, the location determining hole 430 formed on the LED module 400 and the location determining hole 330 formed on the reflector 300 may be configured to correspond to each other. The location determining bar 230 may then be inserted into both location determining holes 330 and 430 such that the components may be correctly aligned.

In addition, when the connector b1 is a bolt or screw having a protruding head, a recess 370 may be provided on the rear surface of the reflector 300 to insertedly seat and provide clearance for the head of the connector b1 (see FIGS. 2 and 3). For example, the coupling member b1 may be provided to couple the LED module 400 to the heat sink 600. The recess 370 may provide clearance for the head of the coupling member b1 such that it does not interfere with the positioning or alignment of the reflector 300 over the LED module 400.

Referring to FIG. 7C, the projected partition 350 may be formed to correspond to the seating recess 250 of the lens assembly 200. For example, the projected partition 350 may be formed in concentric circles or rings that correspond to the seating recess 250 formed by concentric rows of condensing lenses 220. The projected partition 250 may then be seated in a corresponding seating recess 250.

The side surfaces 351, 352 of the projected partition 350 may be configured to correspond to the sloped sides 220*s* of the condensing lenses 220. In certain embodiments, the side surfaces 351, 352 may be formed to correspond to the contour of adjacent condensing lenses 220. For example, the side surfaces 351, 352 may incline in a linear line to form a triangular cross-section when the lens 220 is cone shaped lens, a curved line to form a semispherical cross-section when the lens 220 is semispherical (semispherical lens), or another appropriate shape that corresponds to the shape the condensing lens 220.

Moreover, an inner sloped side surface 351 of the projected partition 350 may have a predetermined angle of incline that corresponds to an angle of incline of the sloped side 220*s* of the condensing lens 220. When seated in the seating recess 250, the inner side surface 351 of the partition 350 may be positioned adjacent to an outer sloped side surface 220*s* of each of the corresponding condensing lenses 220. In other words, the projected partition 350 may be configured to surround a group of condensing lenses 220 to reflect or redirect light escaping the condensing lenses 220 back towards the condensing lenses 220.

The outer side surface 352 of the partition 350 may be formed to correspond to the shape of a group of condensing lenses 220 facing the outer side surface. For example, the outer side surface 352 may be inclined at an angle that corresponds to an angle of the condensing lenses 220 adjacent to that surface. Moreover, the shape or contour of the outer side surface 352 may be formed to correspond to the shape or contour of the corresponding condensing lenses 220.

As described, the inner side surface 351 and the outer side surface 352 of the projected partition 350 may be shaped to correspond to a shape of respective condensing lenses 220. Hence, the shapes of the inner and outer side surfaces 351, 352 may be different from each other. For example, a first row of condensing lenses 220 that faces inner side surface 351 may have a shape that is different from a shape of a second row of condensing lenses 220 that faces the outer side surface 352. In this case, each side surface 351, 352 of the projected partition 350 may be formed to correspond to the condensing lenses 220 that each surface respectively faces.

Moreover, a plurality of projected partitions 350 may be provided on the reflector 300. A shape (e.g., contour, width, height, or size) of one projected partition 350 may be different from a shape of another projected partition 350. For example, a height of a projected partition 350 positioned near the outer circumference of the reflector 300 may be formed to be higher than a projected partition 350 positioned near the center of the reflector 300.

The lens assembly 200 provided in the lighting device 1000 according to the present disclosure may include the plurality of condensing lenses 220. When the projected partition 350, for example, having a triangular cross-sectional shape, is position adjacent to the condensing lenses 220, assembly efficiency and light distributing efficiency may be improved.

The side surfaces 351, 352 of the projected partitions 350 have been disclosed herein as corresponding to a shape of the condensing lenses 220, however, this disclosure is not limited thereto. For example, the inner side surface 351 may be formed to be a different shape or angle than a corresponding surface 220*s* of the condensing lens 220. The shape of angle of each side surface 351, 352 may be based on a desired light output characteristic or corresponding lens shape.

Figure 8:
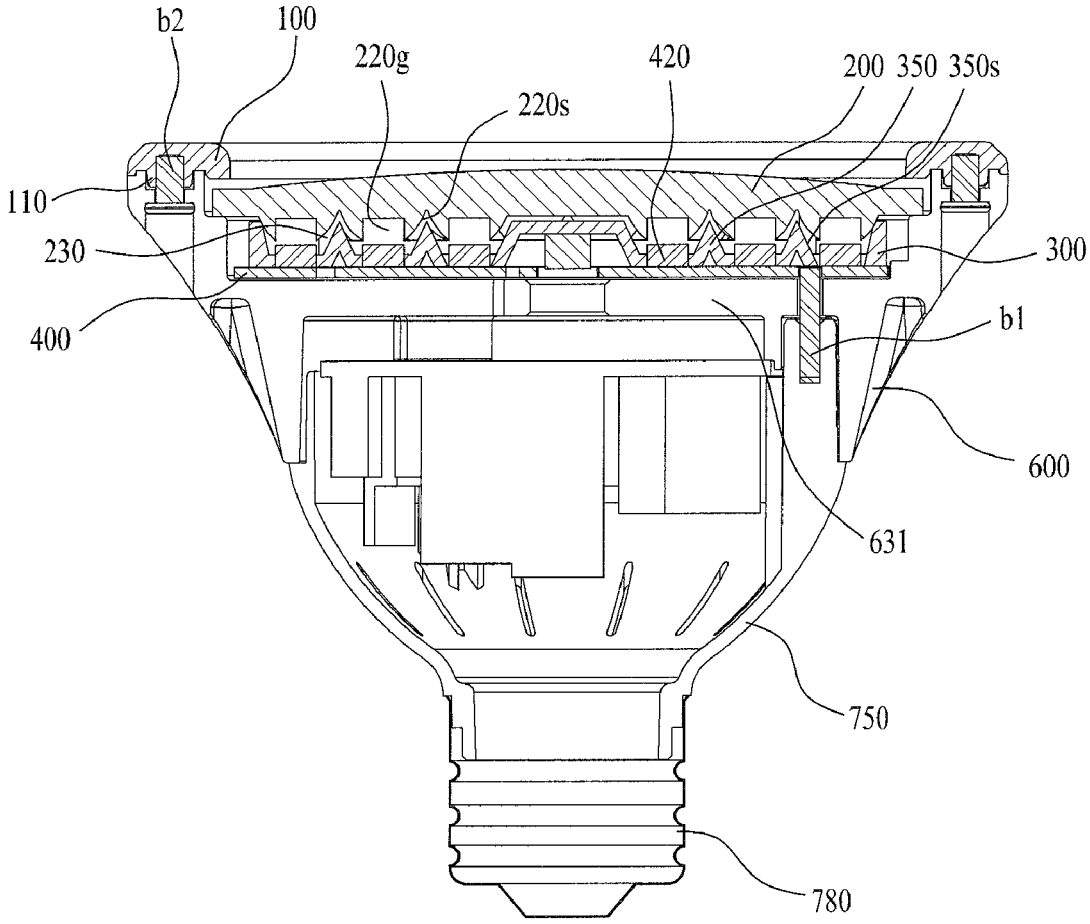
FIG. 8 is a cross-sectional view of the lighting device according to the present disclosure.

FIG. 8 is a cross-sectional view of the lighting device 1000 according to the present disclosure. The recessed portion 220*g* of a condensing lens 220 formed on the rear surface of the lens assembly 200 may be positioned opposite to a corresponding LED 420 of the LED module 400. Light emitted from the LED module 400 may be collected and fully reflected from the sloped side surface 220*s* to be projected via the light emitting surface 210 of the lens assembly 200.

The sloped side surface 220*s* formed around the recessed portion 220*g* of the condensing lens 220 may reflect light collected in the recessed portion 220*g* of the condensing lens 220 toward the light emitting surface 210. Each LED 420 may be positioned opposite to each corresponding recessed portion 220*g* of the condensing lens 220.

The LED may be positioned such that it is not inserted in the recessed portion 220*g* of the condensing lens 220 to prevent excess generation of heat. As a result, there may be light which is emitted in a lateral direction of the LED 420. Such light may be reflected from the sloped side surface 220*s* of the projected partition 350 towards the condensing lens 220. Hence, light distribution efficiency of the lighting device 1000 may be improved and the quantity of light projected through the lens assembly 200 may be increased. While the LED 420 is disclosed in this embodiment as not being inserted in the recessed portion 220*g*, it should be appreciated that, in certain embodiments, the LED 420 may be positioned to extend inside into the recessed portion 220*g*. In this case, thermal characteristics of the LED 400 may be improved using, for example, a heat conduction pad 500 to increase heat dissipation toward the heat sink 600.

Moreover, in certain embodiments, when the LEDs 420 are not inserted in the recessed portions 220*g*, the LEDs 420 may be positioned to be off-center relative to the recess portions 220*g*. That is, while the condensing lenses 220 are disclosed as being positioned to correspond to a position of a corresponding LED 420 and opening 320, this disclosure is not limited thereto, and each LED 420 may be positioned near a condensing lens 220 such that they are not positioned to be centered relative to each other.

Moreover, a sloped side surface 220*s* may be positioned to be adjacent to a side surface 351, 352 of the projected partition 350. A plurality of condensing lenses 220 may be positioned in a circular row that corresponds to a circular projected partition 350. In an embodiment as shown in FIG. 8, a portion of the sloped side surfaces 220*s* of the condensing lenses 220 nearest the outer circumference of the lens assembly 200 may be positioned to touch the inner side surface 351 of the corresponding projected partition 350. In this case, the opposite side surface 352 may be positioned at a predescribed distance away from a row of condensing lenses 220 which it faces. Alternatively, the outer side surface 352 of the projected partition 350 may be configured to be adjacent to a corresponding sloped side surface 220*s*, while the inner side surface 351 is positioned at a predescribed distance therefrom. Moreover, in certain embodiments, both the inner and outer surfaces 351, 352 may be positioned adjacent to the sloped side surfaces 220*s* of the lens 220. For example, the seating recess 250 may be formed to correspond to the shape of the projected partition 350 such that, when mated, both the inner and outer surfaces 351, 352 are positioned adjacent to a surface of the condensing lens 220.

In another embodiment, both the inner and outer side surfaces 351, 352 of the projected partition 350 may be positioned at a predetermined distance from their respective condensing lenses 220. For example, the condensing lenses 220 may be positioned above the reflector 300 without touching the reflector. Here, the lens assembly 200 may be supported on its outer circumferential edge by the heat sink 600 and coupled thereon by coupling-ring 100.

The mounting locations of the lens assembly 200 and the reflector 300 may be determined by the location determining bar 230 and the location determining holes 330. The LED module 400 may also be aligned using the location determining holes 430. After the mounting locations are determined, a connector (coupling member) b2 may couple the lens assembly 200 and the reflector 300 to the heat sink 600 to complete the assembling process of the lighting device 1000. For example, the b2 may couple the cover-ring 100 which supports an outer circumference of the lens assembly 200 to the heat sink 600.

At least one coupling boss 110 may be formed on a rear surface of the cover-ring 100. The heat sink 600 may also include a coupling hole corresponding the coupling boss 110. The cover-ring 100 may be coupled to the heat sink 600 by the coupling member b2 which may be inserted through the heat sink 600 and attached to the cover-ring 100. The coupling member b2 may be attached using the coupling boss 110 of the cover-ring 100 such that coupling member b2 is not exposed or extended beyond the cover-ring 100.

A lighting device, as embodied and broadly described herein, may include a light emitting module that may have a plurality of LEDs mounted thereon in a radial direction; a lens member that may have a plurality of recessed portions formed in a back surface thereof that allows light emitted from the LED to be incident on the recessed portions; and a reflecting member that may be configured to reflect light emitted from the LEDs towards the lens member. The reflecting member may have a plurality of LED holes formed therein along a radial direction to insertedly expose the LEDs of the light emitting modules.

A plurality of condensing lenses that projects toward the LEDs may be provided on the back surface of the lens member and the recessed portions may be located at ends of the condensing lenses. The condensing lenses may be formed on the back surface of the lens member and may be positioned to form a plurality of concentric circles. Moreover, the reflecting member may include a projected partition which may be projected between the condensing lenses. A plurality of projected partitions may be provided and may be positioned to form a plurality of concentric circles.

In another embodiment of the present application or patent, a lighting device may include a light emitting module that may have a plurality of light emitting elements mounted thereon; a lens member that may include a plurality of condensing lenses projected toward the light emitting elements; a heat sink that may be provided in a lower portion of the light emitting module; and a reflecting member that may be provided between the light emitting module and the lens member, wherein the reflecting member may include a plurality of LED holes configured to expose the light emitting elements. The lighting device may also include a partition part configured to distinguish each of the LED holes from each other, wherein the partition part may include one or more projected partition that projects toward the lens member. The partition part may also include a level partition connected to a plurality of projected partitions and configured to connect each of the plurality of projected partitions with each other.

The condensing lenses may be formed concentrically and the projected partition may be projected along a seating recess formed between the concentrically shaped condensing lenses. An end of each condensing lens may include a recessed portion recessed to allow light emitted from the light emitting elements to be incident thereon and a sloped side may be formed around the recessed portion. The recessed portions formed in the plurality of the condensing lenses may be positioned opposite to the plurality of the light emitting elements.

The projected partitions of the reflecting member may be formed to be concentric. An outer surface of the projected partition may have a sloped corresponding to the slope side of the condensing lens. Moreover, the projected partition may have a triangular cross-sectional shape.

A location determining bar configured to determine locations of parts in an assembly process may be provided on either of the lens member or the light emitting module, and a location determining hole may be formed in the other of the two and the reflecting member to insert the location determining bar therein. The location determining bar may be integrally formed with a back surface of the lens member. The location determining bar may be provided on the back surface of the lens member, except an area having the condensing lenses provided therein.

The lighting device may further include a cover-ring coupled to the heat sink, in a state of supporting a circumference of the lens member. At least one coupling boss may be provided on a back surface of the cover-ring and the cover-ring may be coupled to the heat sink via a coupling hole formed in the heat sink by a predetermined coupling member.

According to the present application or patent, the plurality of the light emitting elements may be used to provide a sufficient amount of light. In addition, together with the plurality of the light emitting elements, the reflecting member may efficiently reflect the light emitted from the light emitting elements, to thereby maximize light distribution efficiency. Moreover, according to the lighting device as disclosed herein, the part location determining function may also stabilize or hold the parts together. As a result, coupling members used to couple the parts to each other may be minimized and assembly efficiency may be improved.

A lighting device, as embodied and broadly described herein, may include a housing having a prescribed shape; a light emitting module provided in the housing including a substrate having a plurality of LEDs mounted thereon; a reflector having a first partition and a second partition, wherein the first partition is a first wall having a first and second surface and at least one of the first or second surface being inclined at a first prescribed angle, and the second partition is a second wall having a first and second surface and at least one of the first or second surface of the second wall being inclined at a second prescribed angle, wherein the first partition is provided between a first group of LEDs and a second group of LEDs, and the second partition provided between the second group of LEDs and a third group of LEDs; and a lens assembly positioned on the reflector.

In the lighting device, a height of the first partition may be different from a height of the second partition. The lighting device may further include a plurality of spokes attached to the first partition and the second partition. In this embodiment, the first and second prescribed angles are different angles, the second group of LEDs has more LEDs than the first group of LEDs, and the third group of LEDs has more LEDs than the second group of LEDs.

In the lighting device, the lens assembly may include a plurality of lenses positioned to correspond to the plurality of LEDs of the light emitting module, wherein each of the plurality of lenses have a side surface, and the inclined surface of the first or second partition of the reflector is configured to be positioned adjacent to the side surface of each of the plurality of lenses. Each of the side surfaces of the plurality of lenses are inclined at an angle that corresponds to the prescribed angle of the inclined surface of the corresponding partition. Moreover, the housing is configured to dissipate heat generated by the light emitting module.

In the lighting device, the lens assembly may include a plurality of condensing lenses provided on a surface of the lens assembly and configured to protrude toward the LEDs. Each of the plurality of condensing lenses may include a recessed portion at a distal end of each condensing lens. Moreover, the plurality of condensing lenses may be positioned to form a plurality of concentric rows of condensing lenses, wherein the concentric rows of condensing lenses may be positioned to form circular rows of condensing lenses. In the lighting device, at least one of the first or second partition may be positioned between two of the plurality of concentric rows of condensing lenses and the first and second partitions may be positioned a prescribed distance from the plurality of condensing lenses. In certain embodiments, at least one of the first or second partitions may be positioned adjacent to one of the plurality of concentric rows of condensing lenses.

The lighting device may further include a plurality of third partitions, wherein each of the third partitions are connected to the first partition and the second partition. The plurality of third partitions may be positioned between the LEDs in a radial direction. Moreover, the first and second partitions have a triangular cross-section. In certain embodiments, the lens assembly may include one or more alignment pins positioned on one or more of the plurality of condensing lenses and one or more alignment holes positioned on the reflector and the light emitting module, wherein the one or more alignment pins are positioned to correspond to a position of the one or more alignment holes.

In another embodiment, a lighting device may include a light emitting module having a plurality of LEDs mounted thereon; a lens assembly including a plurality of condensing lenses positioned to correspond to the plurality of LEDs, wherein the condensing lenses are formed to protrude toward the corresponding LEDs; and a reflector provided between the light emitting module and the lens assembly. The reflector may include a plurality of openings positioned to correspond to the plurality of LEDs and condensing lenses, and one or more partitions positioned between the plurality of openings, wherein the one or more partitions are formed to protrude towards the lens assembly.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting device comprising:

a housing having a prescribed shape;

a light emitting module provided in the housing including a substrate having a plurality of LEDs mounted thereon;

a reflector having a first partition and a second partition, wherein the first partition is a first wall having a first and second surface and at least one of the first or second surface being inclined at a first prescribed angle, and the second partition is a second wall having a first and second surface and at least one of the first or second surface of the second wall being inclined at a second prescribed angle, wherein the first partition is provided between a first group of LEDs and a second group of LEDs, and the second partition provided between the second group of LEDs and a third group of LEDs, and a plurality of third partitions, wherein each of the third partitions are connected to the first partition and the second partition; and a lens assembly positioned on the reflector.

2. The lighting device of claim 1, wherein the housing is configured to dissipate heat generated by the light emitting module.

3. The lighting device of claim 1, wherein the plurality of third partitions are positioned between the LEDs in a radial direction.

4. The lighting device of claim 1, wherein the first and second prescribed angles are different angles.

5. The lighting device of claim 1, wherein the second group of LEDs has more LEDs than the first group of LEDs.

6. The lighting device of claim 1, wherein the third group of LEDs has more LEDs than the second group of LEDs.

7. The lighting device of claim 1, wherein the first and second partitions have a triangular cross-section.

8. The lighting device of claim 1, wherein the first and second partitions have a circular shape.

9. A lighting device comprising:

a housing having a prescribed shape;

a light emitting module provided in the housing including a substrate having a plurality of LEDs mounted thereon;

a reflector having a first partition and a second partition, wherein the first partition is a first wall having a first and second surface and at least one of the first or second surface being inclined at a first prescribed angle, and the second partition is a second wall having a first and second surface and at least one of the first or second surface of the second wall being inclined at a second prescribed angle, wherein the first partition is provided between a first group of LEDs and a second group of LEDs, and the second partition provided between the second group of LEDs and a third group of LEDs, and wherein a height of the first partition is different from a height of the second partition; and a lens assembly positioned on the reflector.

10. A lighting device comprising:

a housing having a prescribed shape;

a light emitting module provided in the housing including a substrate having a plurality of LEDs mounted thereon;

a reflector having a first partition and a second partition, wherein the first partition is a first wall having a first and second surface and at least one of the first or second surface being inclined at a first prescribed angle, and the second partition is a second wall having a first and second surface and at least one of the first or second surface of the second wall being inclined at a second prescribed angle, wherein the first partition is provided between a first group of LEDs and a second group of LEDs, and the second partition provided between the second group of LEDs and a third group of LEDs; and a lens assembly positioned on the reflector, wherein the lens assembly includes a plurality of condensing lenses provided on a surface of the lens assembly and configured to protrude toward the LEDs, and wherein each of the plurality of condensing lenses includes a recessed portion at a distal end of each condensing lens.

11. The lighting device of claim 10, wherein the plurality of condensing lenses are positioned to farm a plurality of concentric rows of condensing lenses.

12. The lighting device of claim 11, wherein the concentric rows of condensing lenses are positioned to form circular rows of condensing lenses.

13. The lighting device of claim 11, wherein at least one of the first or second partition is positioned between two of the plurality of concentric rows of condensing lenses.

14. The lighting device of claim 11, wherein the first and second partitions are positioned a prescribed distance from the plurality of condensing lenses.

15. The lighting device of claim 11, wherein at least one of the first or second partitions are positioned adjacent to one of the plurality of concentric rows of condensing lenses.

16. A lighting device comprising:

a housing having a prescribed shape;

a light emitting module provided in the housing including a substrate having a plurality of LEDs mounted thereon;

a reflector having a first partition and a second partition, wherein the first partition is a first wall having a first and second surface and at least one of the first or second surface being inclined at a first prescribed angle, and the second partition is a second wall having a first and second surface and at least one of the first or second surface of the second wall being inclined at a second prescribed angle, wherein the first partition is provided between a first group of LEDs and a second group of LEDs, and the second partition provided between the second group of LEDs and a third group of LEDs, and a plurality of spokes attached to the first partition and the second partition; and a lens assembly positioned on the reflector.

17. The lighting device of claim 16, wherein the first and second partitions have a circular shape.

18. The lighting device of claim 16, wherein the first and second partitions are positioned to be concentric to each other.

19. A lighting device comprising:

a housing having a prescribed shape;

a light emitting module provided in the housing including a substrate having a plurality of LEDs mounted thereon;

a reflector having a first partition and a second partition, wherein the first partition is a first wall having a first and second surface and at least one of the first or second surface being inclined at a first prescribed angle, and the second partition is a second wall having a first and second surface and at least one of the first or second surface of the second wall being inclined at a second prescribed angle, wherein the first partition is provided between a first group of LEDs and a second group of LEDs, and the second partition provided between the second group of LEDs and a third group of LEDs; and a lens assembly positioned on the reflector, wherein the lens assembly includes a plurality of lenses positioned to correspond to the plurality of LEDs of the light emitting module, wherein each of the plurality of lenses have a side surface, and the inclined surface of the first or second partition of the reflector is configured to be positioned adjacent to the side surface of each of the plurality of lenses.

20. The lighting device of claim 19, wherein each of the side surfaces of the plurality of lenses are inclined at an angle that corresponds to the prescribed angle of the inclined surface of the corresponding partition.

21. The lighting device of claim 19, wherein the lens assembly includes one or more alignment pins positioned on one or more of the plurality of condensing lenses and one or more alignment holes positioned on the reflector and the light emitting module, wherein the one or more alignment pins are positioned to correspond to a position of the one or more alignment holes.

22. A lighting device comprising:

a light emitting module having a plurality of LEDs mounted thereon;

a lens assembly including a plurality of condensing lenses positioned to correspond to the plurality of LEDs, wherein the condensing lenses are formed to protrude toward the corresponding LEDs; and a reflector provided between the light emitting module and the lens assembly, wherein the reflector includes a plurality of openings positioned to correspond to the plurality of LEDs and condensing lenses, and one or more partitions positioned between the plurality of openings, wherein the one or more partitions are formed to protrude towards the lens assembly.

* * * * *